United States Patent [19]

Wilkinson

[11] Patent Number: 4,742,940

[45] Date of Patent: May 10, 1988

[54] DISPENSER FOR FLOWABLE MATERIALS

[75] Inventor: William T. Wilkinson, Chadds Ford, Pa.

[73] Assignee: Package Research, Cleveland, Ohio

[21] Appl. No.: 900,681

[22] Filed: Aug. 27, 1986

Related U.S. Application Data

[63] Continuation-in-part of Ser. No. 704,960, Feb. 25, 1985, abandoned.

[51] Int. Cl.[4] ..... G01F 11/00

[52] U.S. Cl. ..... 222/162; 222/386; 222/405; 222/562

[58] Field of Search ..... 222/386, 390, 562, 160, 222/319, 162, 387, 405

[56] References Cited

U.S. PATENT DOCUMENTS

| | | | |
|---|---|---|---|
| 1,595,889 | 8/1926 | Stevens | 222/386 X |
| 1,724,617 | 8/1929 | Rapellin | 222/390 |
| 2,353,463 | 7/1944 | Harman | 222/386 |
| 2,354,477 | 7/1944 | Radbruch | 222/386 X |
| 2,655,289 | 10/1953 | Peal | 222/386 X |
| 2,724,385 | 11/1955 | Lockhart | 222/386 X |
| 2,751,126 | 6/1956 | Chandler | 222/386 |
| 2,831,483 | 4/1958 | Lorenzo | 222/386 X |
| 2,898,007 | 8/1959 | Gassaway | 222/387 X |
| 3,042,273 | 7/1962 | Bauer et al. | 222/562 X |
| 3,227,161 | 1/1966 | Lorenzo | 222/386 X |
| 4,533,069 | 8/1985 | Drobish | 222/209 |

*Primary Examiner*—Robert J. Spar
*Assistant Examiner*—P. McCoy Smith
*Attorney, Agent, or Firm*—Connolly & Hutz

[57] ABSTRACT

A dispenser for flowable materials such as toothpaste includes a hollow barrel in the form of a cylinder open at its lower end and closed at its upper end with the flowable material being inserted in the cylinder. A plunger, which is also in the form of a hollow cylinder open at its lower end and closed at its upper end is telescopically arranged in the cylinder so that upon telescopic movement of the plunger in the barrel, flowable material is dispensed from a spout at the upper portion of the barrel.

10 Claims, 2 Drawing Sheets

DISPENSER FOR FLOWABLE MATERIALS

CROSS-REFERENCE TO RELATED APPLICATION

This application is a continuation-in-part of application Ser. No. 704,960 filed Feb. 25, 1985, now abandoned.

BACKGROUND OF THE INVENTION

The present invention relates to a dispenser for flowable materials such as toothpaste. The conventional manner of dispensing toothpaste is to provide a tube wherein the remote end can be rolled or squeezed to force the toothpaste from the dispenser. Recently there has been a trend away from such conventional techniques, such as by the utilization of rigid tubes with, for example, a pump device for effecting the dispensing operation.

Parent application Ser. No. 704,960 relates to an improved dispenser which is particularly adapted for dispensing flowable materials such as toothpaste. In that device a pair of telescopically arranged cylinders are provided with the flowable material housed in the outer cylinder so that the inner cylinder functions as a piston to force the material from a dispensing spout. The present invention is directed to variations of the general teachings in the parent application.

SUMMARY OF THE INVENTION

An object of this invention is to provide a dispenser for flowable materials which can be operated in a simple and convenient manner.

A further object of this invention is to provide such a dispenser which can be economically mass produced due to its simple construction.

A yet further object of this invention is to provide such a dispenser which effectively dispenses substantially all of the contents thereof with minimum waste of the remaining contents.

In accordance with this invention the dispenser includes a rigid sleeve or barrel made of two piece construction which when assembled together forms a hollow cylinder opened at its lower end and closed at its upper end. A spout is provided in the vicinity of the closed end with a cap selectively closing the spout. Slidably mounted within the barrel is a rigid piston which also is in the form of a cylinder closed at its upper end and open at its lower end. By slidable movement of the piston or inner cylinder within the barrel or outer cylinder the flowable material is dispensed from the spout. Because the outer cylinder is made of two piece construction the flowable material can be top loaded before the two pieces are assembled together with the assembly of the two pieces then taking place.

THE DRAWINGS

DETAILED DESCRIPTION

FIGS. 1–5 illustrate a dispenser 10 in accordance with this invention. Many of the features of dispenser 10 incorporate features of the dispenser shown and described in parent application Ser. No. 704,960, the details of which are incorporated herein by reference thereto. Accordingly, some of the features in common with the dispenser of the parent application will not be described other than is necessary for an understanding of the present invention.

Figure 4:
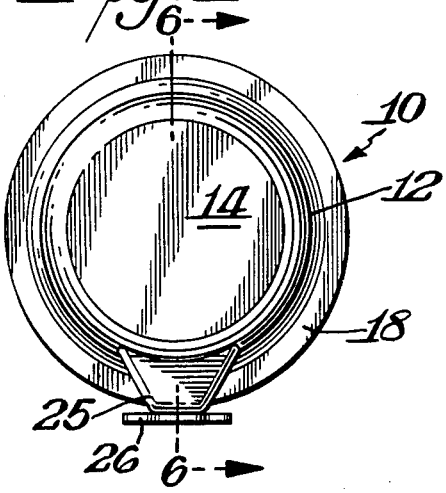
FIGS. 4–5 are top and bottom plan views of the dispenser shown in FIGS. 1–3.
Figure 5:
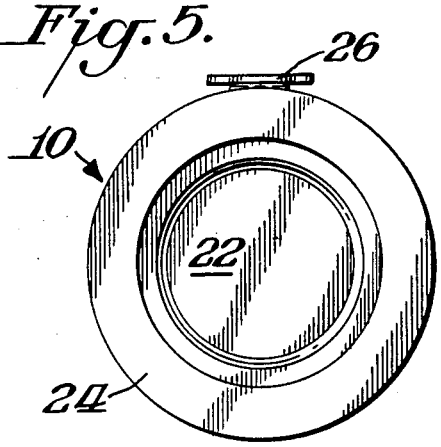
Figure 1:
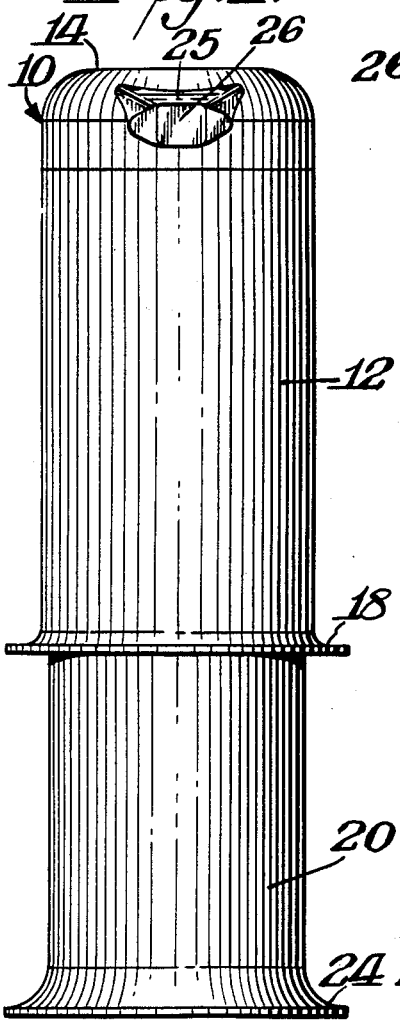
FIG. 1 is a front elevation view of a dispenser in accordance with this invention.
Figure 2:
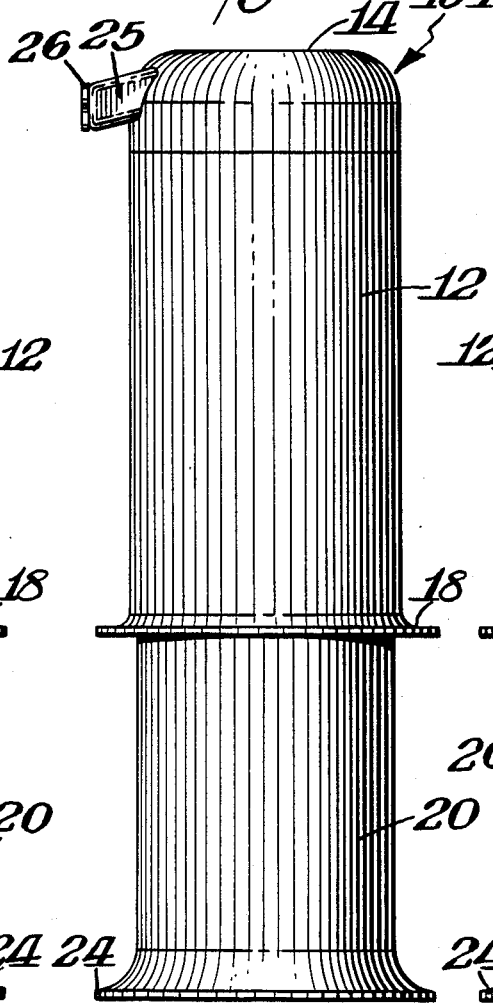
FIGS. 2–3 are side and rear elevation views of the dispenser shown in FIG. 1.
Figure 3:
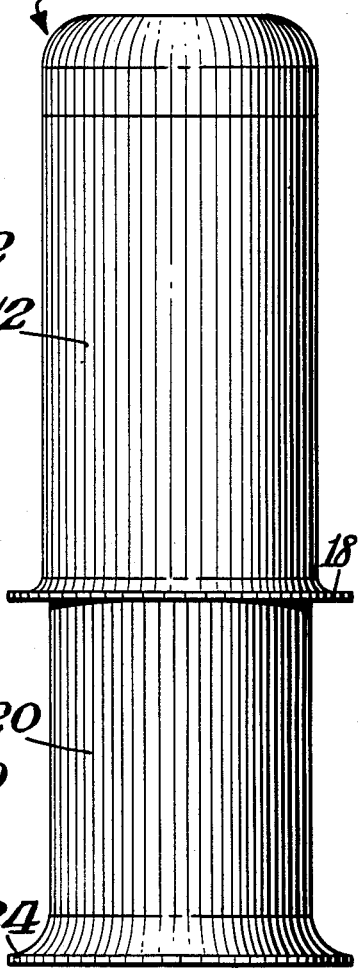
Figure 6:
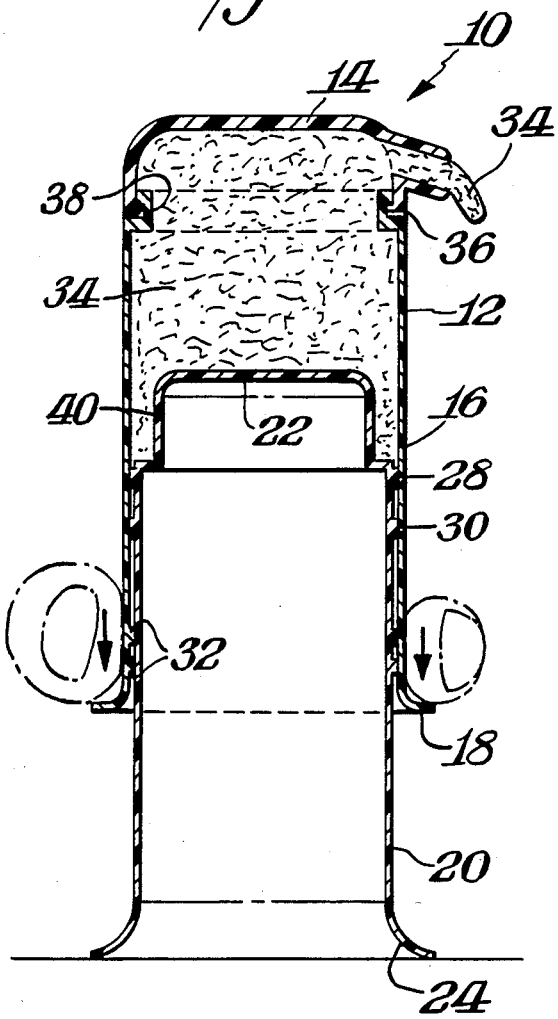
FIG. 6 is a cross-sectional view taken through FIG. 4 along the line 6—6.

As shown in FIG. 6 dispenser 10 includes a rigid sleeve or barrel 12 of any suitable shape and preferably in the form of a hollow cylinder which is open at its lower end and closed at its upper end. The upper end of barrel 12 actually includes a cap portion 14 which is snapped onto the lower cylindrical portion 16. The open end of barrel 12 is flared as indicated by the reference numeral 18 to provide a convenient surface which may be manipulated by the user in pushing the barrel 12 downwardly as illustrated in FIG. 6.

As in the device of the parent application barrel 12 may also include a set of spring fingers slidably mounted within and extending from barrel 12. Within barrel 12 is a rigid piston 20 of a shape conforming to the shape of barrel 12. The upper end of piston 20 has a closed end which functions as a piston head 22. The lower end of piston 20 is outwardly flared at its periphery as indicated by the reference numeral 24. Flared end 24 provides stability whereby dispenser 10 may stand upright on the flared end as shown in FIG. 6. Piston or plunger 20 is preferably hollow to minimize manufacturing costs and complications.

The closed upper end of barrel 12 includes a dispensing spout 25 which communicates with the interior of barrel 12. A closure 26 (FIG. 4) of any suitable type, such as a plug, cap or tape, is detachably secured to dispensing spout 25 for permitting the spout to be selectively opened. It is preferred that the closure 26 be permanently attahced to barrel 12 at, for example, one end to avoid the possibility of the closure being lost or misplaced.

Figure 7:
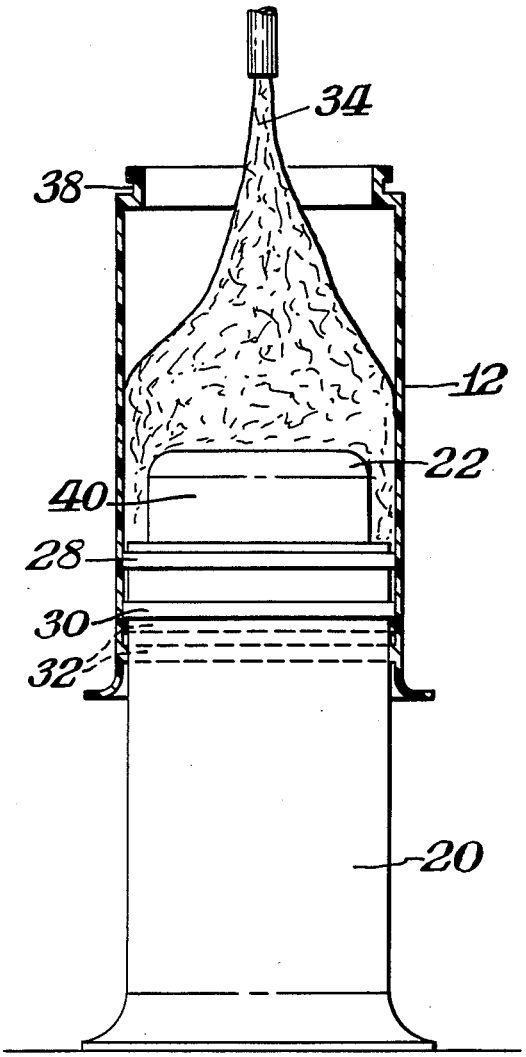
FIG. 7 is a cross-sectional view of the dispenser shown in FIGS. 1–5 during the filling of the dispenser with the flowable material.

As illustrated in FIGS. 6–7 piston 20 includes peripheral contact surfaces 28, 30 which make sealing engagement with the inner surface of barrel 12 during the relative sliding motion of piston 20 within barrel 12. If desired a sealing material such as a washer may be provided between the contact surfaces to further aid in the piston action and to assure sealing contact between the piston and barrel.

During assembly of dispenser 10 piston 20 is snapped into the lower open end of barrel 12. The inner surface at the lower open end of barrel 12 also includes spaced contact surfaces 32. Because of the nature of the plastic material used for piston 20 and barrel 12 there is sufficient resiliency to permit such a mode of assembly while still providing the necessary rigidity required for the device. After barrel 12 and piston 20 have been assembled and before cap 14 has been mounted on the cylindrical sleeve portion 16 and flowable material 34 is inserted into the open upper end of barrel 12 while barrel 12 is in its upper most position as illustrated in FIG. 7. Material 34 is inserted until the hollow cylinder 16 is completely filled wtih the material 34. The next step of assembly would be to couple cap 14 onto cylinder 16 by snapping peripheral flange 36 of cap 14 into groove 38 of cylinder 16. Device 10 is then ready for final packaging as a commercial item.

As shown in FIGS. 6–7 plunger 20 terminates at its upper piston head end 22 in a recessed boss portion 40 which is of a lesser diameter than the remaining portion of plunger 20 so that boss portion 40 is spaced from the inner surface of barrel 12. Plunger 20 is also of a greater length than the length of sleeve 16. Thus when plunger 20 is in its fully telescoped position boss portion 40 extends beyond sleeve 16 and into cap 14 to force material 34 out of spout 25 in the depending peripheral skirt of cap 14. In this position flange 18, which is generally of the same size and shape as flange 24 and coterminous therewith, generally contacts flange 24. Flange 24 thus functions as a stop to limit the extent of telescopic movement of plunger 20.

What is claimed is:

1. A dispenser for flowable materials comprising a barrel in the form of a cylindrical sleeve open at its upper end and its lower end, said barrel further comprising a cup shaped cap connected to and closing said upper end of said sleeve, a dispensing spout at the upper end of said cap, a hollow cylindrical plunger telescopically mounted in said barrel, said plunger being open at its lower end and having a closed upper end, peripheral portions on the inner surface of said sleeve and on the outer surface of said plunger being in sliding sealing contact with each other, said closed upper end of said plunger comprising a piston head whereby telescopic movement of said plunger in said barrel forces the flowable material in said barrel out of said dispensing spout, said plunger being of a length longer than the length of said sleeve with said piston head extending beyond said sleeve and into said cap when said plunger is fully telescoped into said barrel, said piston head having an annular shoulder and a cylindrical boss portion extending away from said shoulder, said boss portion being of lesser diameter than the remaining portion of said plunger, the outer surface of said boss portion being spaced from the inner surface of said sleeve and of said cap, said dispensing spout being on a peripheral skirt of said cap and extending outwardly beyond said cap and said sleeve, said sleeve having an internal peripheral projection at its said upper end, a peripheral groove in the outer surface at said peripheral projection, a peripheral ledge on the inner surface of said skirt of said cap, said sleeve and said cap and said plunger being made of a molded plastic, said ledge of said cap being snapped into said groove of said sleeve, said upper end of said sleeve having the same outside diameter as the outside diameter of said skirt to present a uniform surface where said cap is secured to said sleeve, and said shoulder being at least as wide as the distance said peripheral projection extends inwardly from the inner surface of said sleeve to permit said outer surface of said boss portion to be telescoped beyond said peripheral projection to maximize the amount of flowable material dispensed from said spout.

2. The dispenser of claim 1 wherein said lower end of said sleeve is outwardly flared to provide a manipulating surface for the user.

3. The dispenser of claim 2 wherein said lower end of said plunger is outwardly flared to enhance the stability of said dispenser when in its upright position on a support surface.

4. The dispenser of claim 3 wherein said flared lower ends are coterminous and generally in contact with each other when said plunger is fully telesccoped into said barrel.

5. The dispenser of claim 4 including a closure selectively closing said dispensing spout.

6. The dispenser of claim 1 wherein said spout is integral with said cap.

7. The dispenser of claim 1, in combination therewith, flowable material in said barrel, and said flowable material being toothpaste.

8. The dispenser of claim 1 including a pair of peripheral contact surfaces on said outer surface of said plunger in sealing contact with said inner surface of said sleeve.

9. The dispenser of claim 8 including spaced contact surfaces on said inner surface of said sleeve, said pair of peripheral contact surfaces of said plunger being snapped over said contact surfaces of said sleeve during assembly of said plunger in said sleeve.

10. The dispenser of claim 9 wherein said pair of peripheral contact surfaces is generally located at said upper end of said plunger, and said spaced contact surfaces of said sleeve being generally located at said lower end of said sleeve.

* * * * *